US009542898B2

(12) United States Patent
Feng et al.

(10) Patent No.: US 9,542,898 B2
(45) Date of Patent: Jan. 10, 2017

(54) DRIVING METHOD OF A LIQUID CRYSTAL DISPLAY PANEL, A LIQUID CRYSTAL DISPLAY PANEL AND A DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui Province (CN)

(72) Inventors: Xia Feng, Beijing (CN); Jiacheng Huang, Beijing (CN); Donghui Wang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui Province (CN)

( * ) Notice: Subject to any disclaimer, the term of this patent is extended or adjusted under 35 U.S.C. 154(b) by 0 days.

(21) Appl. No.: 14/408,561

(22) PCT Filed: Jun. 9, 2014

(86) PCT No.: PCT/CN2014/079490

§ 371 (c)(1),
(2) Date: Dec. 16, 2014

(87) PCT Pub. No.: WO2015/096403

PCT Pub. Date: Jul. 2, 2015

(65) Prior Publication Data

US 2016/0293123 A1 Oct. 6, 2016

(30) Foreign Application Priority Data

Dec. 26, 2013 (CN) ..... 2013 1 0737029

(51) Int. Cl.
*G09G 3/36* (2006.01)

(52) U.S. Cl.
CPC ..... *G09G 3/3614* (2013.01); *G09G 3/3677* (2013.01); *G09G 2310/027* (2013.01); *G09G 2310/0291* (2013.01); *G09G 2330/021* (2013.01)

(58) Field of Classification Search
CPC ... G09G 3/3614; G09G 3/3648; G09G 3/3688
See application file for complete search history.

(56) References Cited

U.S. PATENT DOCUMENTS 5,936,596 A * 8/1999 Yoshida ..... G02F 1/1323 345/87
7,006,114 B2 * 2/2006 Sakaguchi ..... G09G 3/3696 345/100

(Continued)

FOREIGN PATENT DOCUMENTS

CN 101645247 A 2/2010
CN 201716962 U 1/2011

(Continued)

OTHER PUBLICATIONS

International Search Report with English Language Translation, dated Sep. 26, 2014, Application No. PCT/CN2014/079490.

(Continued)

*Primary Examiner* — Ricardo L Osorio
(74) *Attorney, Agent, or Firm* — Blakely Sokoloff Taylor & Zafman LLP

(57) ABSTRACT

This invention provides a liquid crystal display panel, a source driver in the liquid crystal display panel comprises an amplifier whose amplification coefficient is adjustable, the amplifier can adjust a received data signal based on a currently selected amplification coefficient, and output the adjusted data signal to a data line that is currently signally-connected with the amplifier, moreover, the currently selected amplification coefficient is inversely proportional to a rate at which the data line charges a current signally- (Continued)

connected sub-pixel unit. For the case that the rate at which the data line charges the sub-pixel unit is relatively low, a relative large amplification coefficient can be selected, thereby nonuniform brightness of the display image caused by a low charging rate of the sub-pixel unit can be avoided; for the case that the rate at which the data line charges the sub-pixel unit is relatively high, a relatively small amplification coefficient is selected, thereby unnecessary power consumption can be saved. This invention further provides a display device comprising such a liquid crystal display panel and a driving method for use in such a liquid crystal display panel.

15 Claims, 6 Drawing Sheets

(56) References Cited

U.S. PATENT DOCUMENTS

| | | | | |
|---|---|---|---|---|
| 7,646,371 | B2 * | 1/2010 | Maki | G09G 3/3688 345/211 |
| 7,746,336 | B2 * | 6/2010 | Morita | G09G 3/3688 345/204 |
| 8,174,517 | B2 * | 5/2012 | Morita | G09G 3/2011 345/211 |
| 8,896,513 | B2 * | 11/2014 | Bi | H03M 1/682 345/690 |
| 9,196,207 | B2 * | 11/2015 | Lee | G09G 3/3677 |
| 9,244,581 | B2 * | 1/2016 | Morein | G06F 3/0412 |
| 2006/0092112 | A1 | 5/2006 | Moon | |
| 2009/0015297 | A1 | 1/2009 | Chen et al. | |
| 2010/0231617 | A1 | 9/2010 | Ueda et al. | |

FOREIGN PATENT DOCUMENTS

| | | |
|---|---|---|
| CN | 102063885 A | 5/2011 |
| CN | 102157136 | 8/2011 |
| CN | 102456310 A | 5/2012 |
| CN | 203311139 U | 11/2013 |
| CN | 103676256 A | 3/2014 |
| EP | 1927888 | 6/2008 |

OTHER PUBLICATIONS

Chinese Office Action with English Language Translation, dated Sep. 6, 2015, Chinese Application No. 2013107370293.

Chinese Certificate of Patent, Issued Mar. 2, 2016, Chinese Application No. ZL201310737029.3.

* cited by examiner

DRIVING METHOD OF A LIQUID CRYSTAL DISPLAY PANEL, A LIQUID CRYSTAL DISPLAY PANEL AND A DISPLAY DEVICE

FIELD OF THE INVENTION

This invention relates to the field of display technology, particularly to a liquid crystal display panel, a display device comprising such a liquid crystal display panel and a driving method for use in such a liquid crystal display panel.

BACKGROUND OF THE INVENTION

With the development of the display product technology, people's requirement on appearance and size of the display product becomes higher and higher, there are also more and more applications of narrow frame design of the thin film transistor (TFT) liquid crystal display (LCD) panel. At present, most TFT-LCD panels adopt Dual Layer design or Dual Gate design to narrow the frame.

In a liquid crystal display panel of Dual Layer design, as shown in FIG. 1, in order to narrow the frame, a wiring 02 between the source driver (IC) 01 and the data line Data is arranged on different metal layers, i.e., the wiring 02 connecting a data line Data whose serial number is an even number (also called an even numbered data line) is located on a metal layer, the wiring 02 connecting a data line Data whose serial number is an odd number (also called an odd numbered data line) is located on another metal layer. Due to different metal materials used and layer thickness between different metal layers, the resistance between adjacent wirings 02 may be different, consequently, the rates at which adjacent data lines Data charge adjacent sub-pixel units 03 that are signally-connected with them are inconsistent, thereby resulting in bright and dark stripes, i.e. V-Line flaw, on the liquid crystal display panel in image display.

In a liquid crystal display panel of Dual Gate design, as shown in FIG. 2, in order to narrow the frame, the number of the data lines Data is half reduced, two adjacent columns of sub-pixel units 03 constitute a group of sub-pixel unit column, each group of sub-pixel unit columns share a data line Data located between the two columns of sub-pixel units 03, in this way, the data line Data needs to charge the two adjacent columns of sub-pixel units 03 alternately, and the polarity is opposite, the charging order is as shown by arrows in FIG. 3. From FIG. 2 and FIG. 3 it can be seen that in two columns of sub-pixel units 03 connected with a data line, there is always a column of sub-pixel units whose polarity needs to be reversed when the data line charges it, while the polarity of the other column of sub-pixel units does not need to be reversed when the data line charges it, consequently, the rates at which the same data line Data charges respectively two adjacent columns of sub-pixel units 03 that are signally-connected with it are inconsistent, thereby also resulting in bright and dark stripes, i.e. V-Line flaw, on the liquid crystal display panel in image display.

Therefore, how to solve the problem of nonuniform display image of the liquid crystal display panel caused by inconsistency of the rate at which the data line charges the sub-pixel units is a technical problem to be solved by the skilled person in the art.

SUMMARY OF THE INVENTION

The embodiments of this invention provides a liquid crystal display panel, a display device comprising such a liquid crystal display panel and a driving method for use in such a liquid crystal display panel, for improving uniformity of the display image of the liquid crystal display panel and reducing unnecessary power consumption.

According to one aspect of this invention, a liquid crystal display panel is provided, comprising an array substrate, data lines located on the array substrate, sub-pixel units signally-connected with the data lines, and a source driver signally-connected with each of the data lines.

The source driver comprises: an amplifier whose amplification coefficient is adjustable, the amplifier being used for adjusting a received data signal based on a currently selected amplification coefficient, and outputting the adjusted data signal to a data line that is currently signally-connected with the amplifier; the currently selected amplification coefficient is inversely proportional to a rate at which the data line charges a current signally-connected sub-pixel unit.

Specifically, when the data line charges a current signally-connected sub-pixel unit at a first rate, the amplifier selects a first amplification coefficient; and when the data line charges the current signally-connected sub-pixel unit at a second rate lower than the first rate, the amplifier selects a second amplification coefficient higher than the first amplification coefficient.

In the above liquid crystal display panel provided in the embodiment of this invention, the source driver comprises an amplifier whose amplification coefficient is adjustable, the amplifier can adjust a received data signal based on a currently selected amplification coefficient, and output the adjusted data signal to a data line that is currently signally-connected with the amplifier, moreover, the currently selected amplification coefficient is inversely proportional to a rate at which the data line charges a current signally-connected sub-pixel unit. Hence, for the case that the rate at which the data line charges the sub-pixel unit is relatively low, a relative large amplification coefficient can be selected, thereby nonuniform brightness of the display image caused by a low charging rate of the sub-pixel unit can be avoided; for the case that the rate at which the data line charges the sub-pixel unit is relatively high, a relatively small amplification coefficient is selected, thereby unnecessary power consumption can be saved.

According to an embodiment of this invention, the amplifier comprises a plurality of positive signal amplifiers and a plurality of negative signal amplifiers.

The source driver further comprises: a first adjustment unit adjusting amplification coefficient of the positive signal amplifier, and a second adjustment unit adjusting amplification coefficient of the negative signal amplifier.

The first adjustment unit is connected between a negative phase signal input end of the positive signal amplifier and an output end of the positive signal amplifier in series; and the second adjustment unit is connected between a positive phase signal input end of the negative signal amplifier and an output end of the negative signal amplifier in series.

According to an embodiment of this invention, the first adjustment unit and the second adjustment unit comprise resistances whose resistance values are adjustable.

According to an embodiment of this invention, the source driver further comprises an output polarity control unit.

An odd numbered data line and an even numbered data line are taken as a group of data lines, the group of data lines are connected with a positive signal amplifier and a negative signal amplifier respectively through the output polarity control unit.

At a first moment, the output polarity control unit turns on the positive signal amplifier and the odd numbered data line, the output polarity control unit turns on the negative signal amplifier and the even numbered data line.

At a second moment, the output polarity control unit turns on the positive signal amplifier and the even numbered data line, the output polarity control unit turns on the negative signal amplifier and the odd numbered data line.

According to an embodiment of this invention, the source driver further comprises: first digital to analog conversion units in one-to-one correspondence with the plurality of positive signal amplifiers, and second digital to analog conversion units in one-to-one correspondence with the plurality of negative signal amplifiers.

The first digital to analog conversion unit is used for performing digital to analog converstion to a received positive gamma voltage, and outputting the digital to analog converted positive gamma voltage to a positive phase signal input end of a corresponding positive signal amplifier.

The second digital to analog conversion unit is used for performing digital to analog converstion to a received negative gamma voltage, and outputting the digital to analog converted negative gamma voltage to a negative phase signal input end of a corresponding negative signal amplifier.

According to an embodiment of this invention, a data line is signally-connected with a corresponding column of sub-pixel units.

The even numbered data line is signally-connected with the source driver through a first wiring, the odd numbered data line is signally-connected with the source driver through a second wiring, wherein, the first wiring and the second wiring are arranged in different layers on the array substrate.

According to an embodiment of this invention, two adjacent columns of sub-pixel units are taken as a group of sub-pixel unit columns, each group of sub-pixel columns share a data line located between the two columns of sub-pixel units, and there are two gate lines between sub-pixel units of adjacent rows.

According to another aspect of this invention, a display device is provided, comprising a liquid crystal display panel according to the present invention.

According to another aspect of this invention, a driving method of a liquid crystal display panel is provided, comprising:

selecting a current amplification coefficient of an amplifier signally-connected with a data line in the source driver based on a rate at which the data line charges a current signally-connected sub-pixel unit, the currently selected amplification coefficient being inversely proportional to the rate at which the data line charges a current signally-connected sub-pixel unit;

the amplifier adjusting a received data signal based on the currently selected amplification coefficient, and outputting the adjusted data signal to a data line that is currently signally-connected with the amplifier.

Specifically, when the data line charges a current signally-connected sub-pixel unit at a first rate, the amplifier selects a first amplification coefficient; and when the data line charges the current signally-connected sub-pixel unit at a second rate lower than the first rate, the amplifier selects a second amplification coefficient higher than the first amplification coefficient.

In the driving method of a liquid crystal display panel provided in the embodiment of this invention, based on a rate at which a data line charges a current signally-connected sub-pixel unit, a current amplification coefficient of an amplifier signally-connected with the data line in the source driver can be selected, and the currently selected amplification coefficient is inversely proportional to the rate at which the data line charges a current signally-connected sub-pixel unit; the amplifier adjusts a received data signal based on the currently selected amplification coefficient, and outputs the adjusted data signal to a data line that is currently signally-connected with the amplifier. Hence, for the case that the rate at which the data line charges the sub-pixel unit is relatively low, a relative large amplification coefficient can be selected, thereby nonuniform brightness of the display image caused by a low charging rate of the sub-pixel unit can be avoided; for the case that the rate at which the data line charges the sub-pixel unit is relatively high, a relatively small amplification coefficient is selected, thereby unnecessary power consumption can be saved.

DETAILED DESCRIPTION OF THE INVENTION

Next, the liquid crystal display panel, the display device and the driving method of the liquid crystal display panel provided by the embodiments of this invention will be explained in detail with reference to the drawings.

Figure 1:
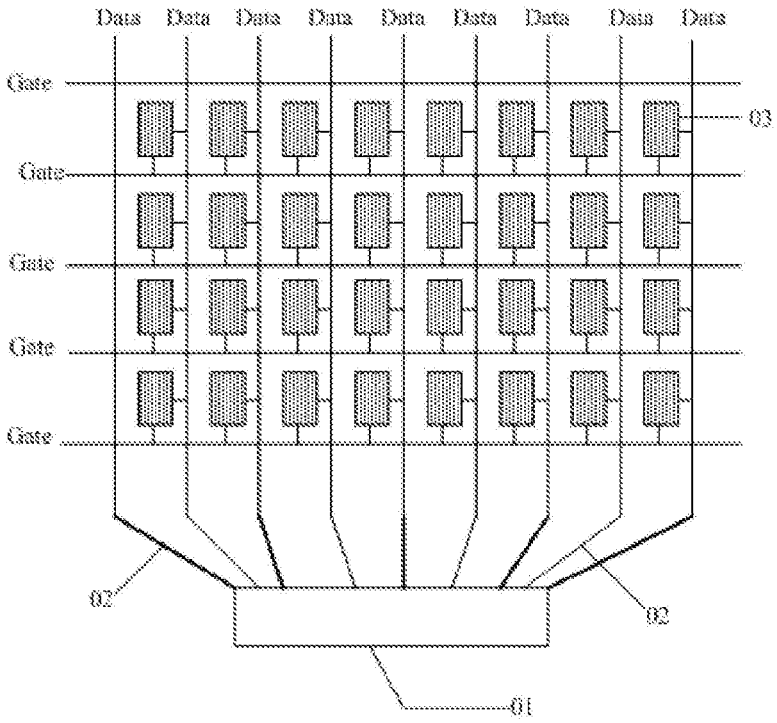
FIG. 1 is a schematic view of structure of a liquid crystal display panel of the existing Dual Layer design.
Figure 2:
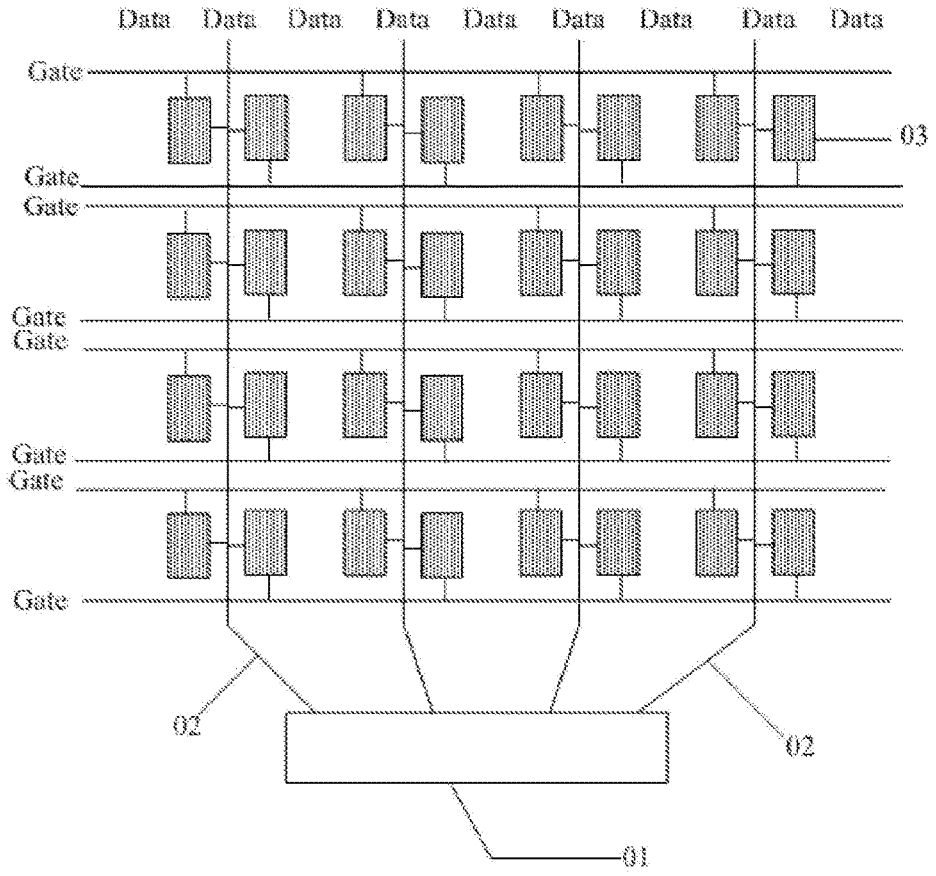
FIG. 2 is a schematic view of structure of a liquid crystal display panel of the existing Dual Gate design.
Figure 3:
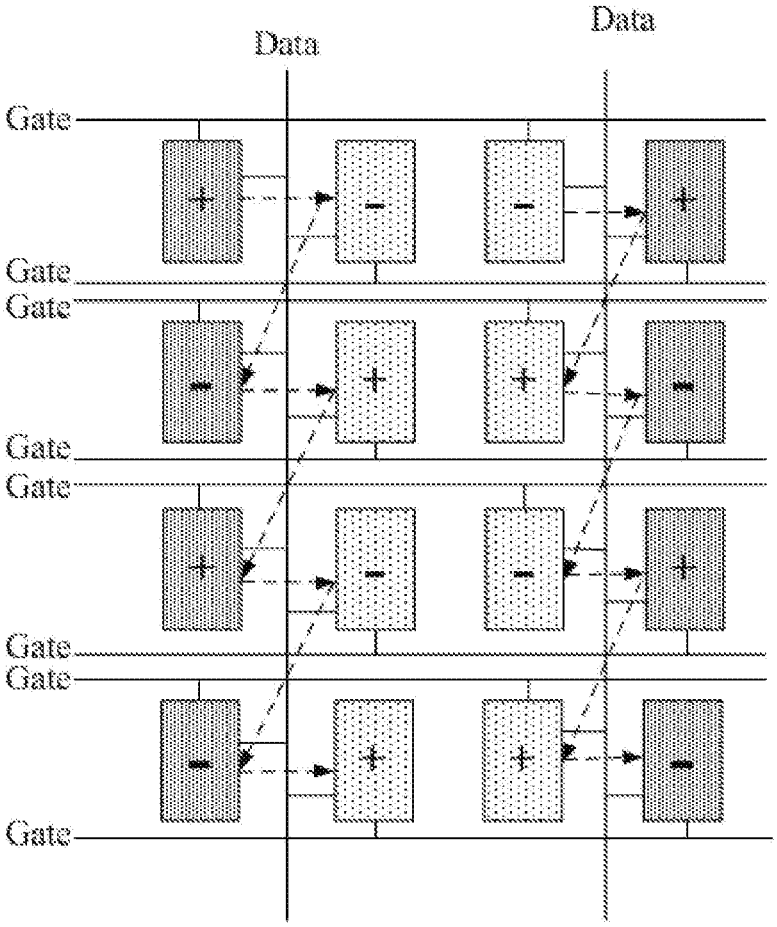
FIG. 3 is a schematic view of the charging sequence of the data lines charging the pixel units in the liquid crystal display panel as shown in FIG. 2.
Figure 4:
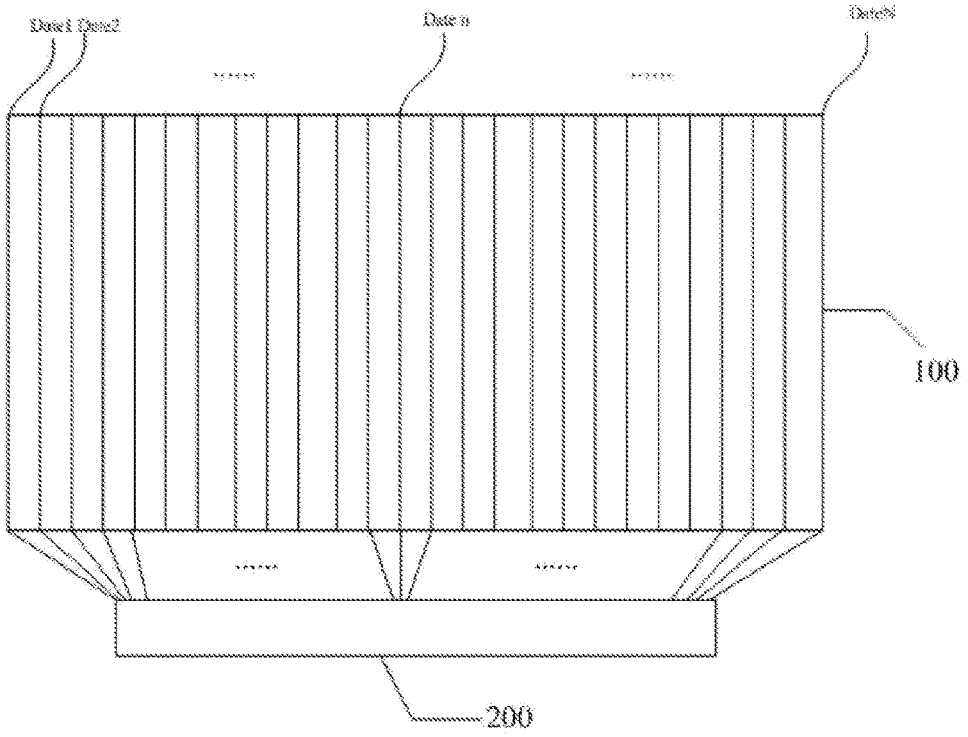
FIG. 4 is a schematic view of structure of a liquid crystal display panel provided according to an embodiment of this invention.

An embodiment of this invention provides a liquid crystal display panel, as shown in FIG. 4, comprising an array substrate 100, data lines Data n (n=1, 2, 3, . . . N, N is the number of the data lines) located on the array substrate 100, sub-pixel units (the structure of the sub-pixel unit is not shown in FIG. 4) signally-connected with the data lines Data n, and a source driver 200 (the specific structure of the source driver is not shown in FIG. 4) signally connected with each of the data lines Data n.

Figure 5:
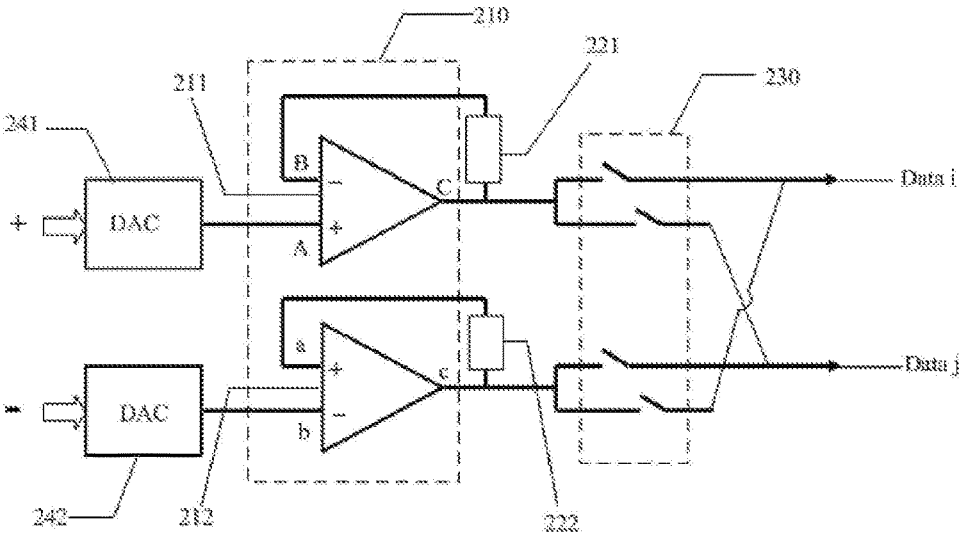
FIG. 5 is a schematic view of structure of a source driver in a liquid crystal display panel provided according to an embodiment of this invention.

The specific structure of the source driver 200 is as shown in FIG. 5, comprising: an amplifier 210 whose amplification coefficient is adjustable, the amplifier 210 being used for adjusting a received data signal based on a currently selected amplification coefficient, and outputting the adjusted data signal to a data line Data n that is currently signally-connected with the amplifier 210. The currently selected amplification coefficient is inversely proportional to a rate at which the data line Data n charges a current signally-connected sub-pixel unit.

Specifically, when the data line charges a current signally-connected sub-pixel unit at a first rate, the amplifier 210 selects a first amplification coefficient; and when the data line charges the current signally-connected sub-pixel unit at a second rate lower than the first rate, the amplifier 210 selects a second amplification coefficient higher than the first amplification coefficient.

In the above liquid crystal display panel provided according to the embodiment of this invention, the source driver comprises an amplifier whose amplification coefficient is adjustable, the amplifier can adjust a received data signal based on a currently selected amplification coefficient, and output the adjusted data signal to a data line that is currently signally-connected with the amplifier, moreover, the currently selected amplification coefficient is inversely proportional to a rate at which the data line charges a current signally-connected sub-pixel unit. Hence, for the case that the rate at which the data line charges the sub-pixel unit is relatively low, a relative large amplification coefficient can be selected, thereby nonuniform brightness of the display image caused by a low charging rate of the sub-pixel unit can be avoided; for the case that the rate at which the data line charges the sub-pixel unit is relatively high, a relatively small amplification coefficient is selected, thereby unnecessary power consumption can be saved.

Preferably, in the above liquid crystal display panel provided according to the embodiment of this invention, as shown in FIG. 5, the amplifier 210 comprises a plurality of positive signal amplifiers 211 and a plurality of negative signal amplifiers 212.

The source driver 200 further comprises: a first adjustment unit 221 adjusting amplification coefficient of the positive signal amplifier 211, and a second adjustment unit 222 adjusting amplification coefficient of the negative signal amplifier 212.

The first adjustment unit 221 is connected between a negative phase signal input end B of the positive signal amplifier 211 and an output end C of the positive signal amplifier 211 in series; and the second adjustment unit 222 is connected between a positive phase signal input end a of the negative signal amplifier 212 and an output end c of the negative signal amplifier in series 212.

Preferably, in the above liquid crystal display panel provided according to the embodiment of this invention, the first adjustment unit and the second adjustment unit comprise resistances whose resistance values are adjustable.

Figure 6:
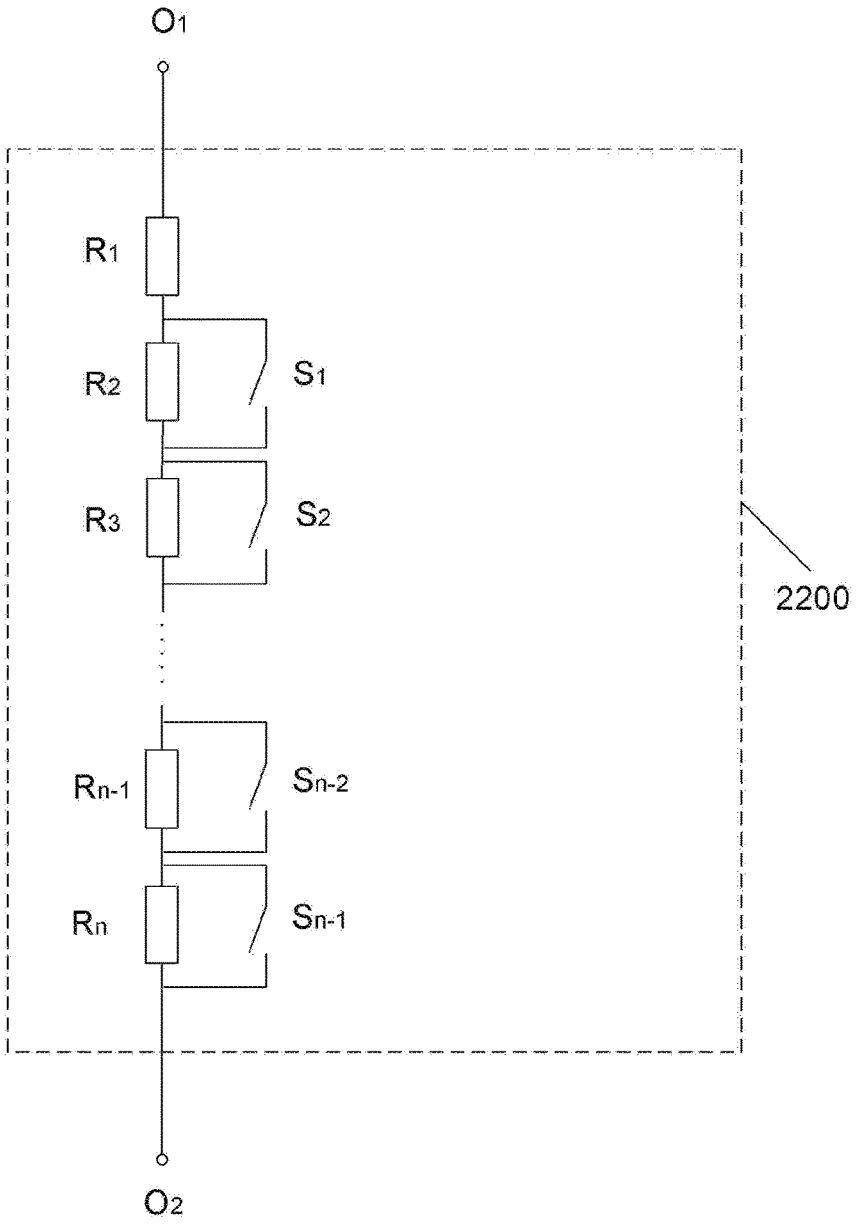
FIG. 6 is a schematic view of structures of a first adjustment unit and a second adjustment unit in a liquid crystal display panel provided according to an embodiment of this invention.

Specifically, in the above liquid crystal display panel provided by the embodiment of the present invention, the resistance 2200 whose resistance value is adjustable may consist of n fixed resistances $R_n$ and n−1 switch units $S_{n-1}$ as shown in FIG. 6.

Specifically, when the first adjustment unit 221 consists of the resistances 2200 whose resistance values are adjustable as shown in FIG. 6, a first signal port $O_1$ of the resistance 2200 whose resistance value is adjustable is used for connecting with the output end C of the positive signal amplifier 211, a second signal port $O_2$ of the resistance 2200 whose resistance value is adjustable is used for connecting with the negative phase signal input end B of the positive signal amplifier 211. When the second adjustment unit 222 consists of the resistances 2200 whose resistance values are adjustable as shown in FIG. 6, the first signal port $O_1$ of the resistance 2200 whose resistance value is adjustable is used for connecting with the output end c of the negative signal amplifier 212, the second signal port $O_2$ of the resistance 2200 whose resistance value is adjustable is used for connecting with the positive phase signal input end a of the negative signal amplifier 212.

Preferably, in the above liquid crystal display panel provided according to the embodiment of this invention, as shown in FIG. 5, the source driver 200 further comprises: an output polarity control unit 230.

An odd numbered data line Data i (i is an odd number greater than 1 and less than or equal to N) and an even numbered data line Data j (j is an even number greater than 1 and less than or equal to N) are taken as a group of data lines. A group of data lines are connected with a positive signal amplifier 211 and a negative signal amplifier 212 respectively through the output polarity control unit 230.

At a first moment, the output polarity control unit 230 turns on the positive signal amplifier 211 and the odd numbered data line Data i, the output polarity control unit 230 turns on the negative signal amplifier 212 and the even numbered data line j; and at a second moment, the output polarity control unit 230 turns on the positive signal amplifier 211 and the even numbered data line Data j, the output polarity control unit 230 turns on the negative signal amplifier 212 and the odd numbered data line Data i.

Preferably, in the above liquid crystal display panel provided according to the embodiment of this invention, an odd numbered data line Data i and an even numbered data line Data j adjacent to each other are preferably taken as a group of data lines, in this way, it is convenient to arrange wirings between the source driver 200 and the data lines Data n, so that the source driver is signally-connected with respective data lines.

Preferably, in the above liquid crystal display panel provided according to the embodiment of this invention, as shown in FIG. 5, the source driver 200 further comprises: first digital to analog conversion unit 241 in one-to-one correspondence with the plurality of positive signal amplifiers 211, and second digital to analog conversion units 242 in one-to-one correspondence with the plurality of negative signal amplifiers 212.

The first digital to analog conversion unit 241 is used for performing digital to analog converstion to a received positive gamma voltage, and outputting the digital to analog converted positive gamma voltage to a positive phase signal input end A of a corresponding positive signal amplifier 211.

The second digital to analog conversion unit 242 is used for performing digital to analog converstion to a received negative gamma voltage, and outputting the digital to analog converted negative gamma voltage to a negative phase signal input end b of a corresponding negative signal amplifier 212.

Preferably, the above liquid crystal display panel provided according to the embodiment of this invention may be in a dual layer structure design, i.e., in the liquid crystal display panel, a data line is signally-connected with a corresponding column of sub-pixel units.

The even numbered data line is signally-connected with the source driver through a first wiring, the odd numbered data line is signally-connected with the source driver through a second wiring; wherein the first wiring and the second wiring are arranged in different layers on the array substrate.

Specifically, in the above liquid crystal display panel of a dual layer structure design, when the resistance of the first wiring is greater than the resistance of the second wiring, if the amplification coefficient of the amplifiers in the source driver is consistent, the rate at which the even numbered data line charges a column of sub-pixel units that are signally-connected with it will be lower than the rate at which the odd numbered data line charges a column of sub-pixel units that are signally-connected with it, hence, the amplification coefficient selected by the amplifier in the source driver that is signally-connected with the even numbered data line should be greater than the amplification coefficient selected by the amplifier in the source driver that is signally-connected with the odd numbered data line, thereby enabling the rate at which the data lines charge respective columns of sub-pixel units in the liquid crystal display panel to be consistent, so as to solve the problem of nonuniform display image of the liquid crystal display panel of the existing dual layer structure design.

Similarly, specifically, in the above liquid crystal display panel of dual layer structure design, when the resistance of the first wiring is less than the resistance of the second wiring, the principle is same as the above, which will not be repeated here.

Specifically, in the above liquid crystal display panel provided according to the embodiment of this invention, the first wiring may be arranged in the same layer as the gate electrode on the array substrate, the second wiring may be arranged in the same layer as the source electrode and the drain electrode on the array substrate Alternatively, the first wiring may be arranged in the same layer as the source electrode and the drain electrode on the array substrate, the second wiring may be arranged in the same layer as the gate electrode on the array substrate, which will not be defined here.

Preferably, the above liquid crystal display panel provided according to the embodiment of this invention may be in a dual gate structure design, i.e., in the liquid crystal display panel, two adjacent columns of sub-pixel units are taken as a group of sub-pixel unit columns, each group of sub-pixel unit columns share a data line located between the two columns of sub-pixel units, and there are two gate lines between the sub-pixel units of adjacent rows.

Specifically, in the above liquid crystal display panel of dual gate structure design, if the amplification coefficients of the amplifiers in the source driver are consistent, in a group of sub-pixel unit columns, it is one data line that charges two columns of sub-pixel units alternately, and the charging polarity is opposite, hence, in the process of charging, the rate at which the data line charges a column of sub-pixel units whose polarity needs to be reversed is lower than the rate at which the data line charges a column of sub-pixel units whose polarity does not need to be reversed, which may result in bright and dark stripes, i.e. V-Line flaw, on the liquid crystal display panel in image display.

Therefore, in the above liquid crystal display panel of dual gate structure design, when the data line charges a column of sub-pixel units whose polarity needs to be reversed, a relatively large amplification coefficient is selected for the amplifier in the source driver that is currently signally-connected with the data line; when the data line charges a column of sub-pixel units whose polarity does not need to be reversed, a relatively small amplification coefficient is selected for the amplifier in the source driver that is currently signally-connected with the data line, thereby enabling the rate at which the data lines charge respective columns of sub-pixel units in the liquid crystal display panel to be consistent, so as to solve the problem of nonuniform display image of the liquid crystal display panel of the existing dual gate structure design.

Based on the same inventive concept, an embodiment of this invention further provides a display device comprising the above liquid crystal display panel provided according to respective embodiments of this invention, the display device may be any product or component such as a mobile telephone, a panel computer, a TV, a display, a laptop, a digital photo frame, a navigator etc. that has the display function. Since the principle of the display device for solving problems is similar as the preceding liquid crystal display panel, the implementation of the display device may make reference to the implementation of the preceding liquid crystal display panel, which will not be repeated.

Figure 7:
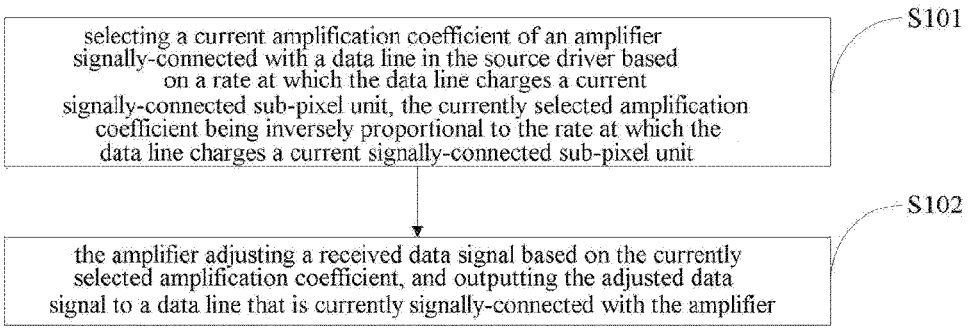
FIG. 7 is a flow chart of a driving method of a liquid crystal display panel provided according to an embodiment of this invention.

Based on the same inventive concept, an embodiment of this invention further provides a driving method of a liquid crystal display panel, as shown in FIG. 7, specifically comprising the steps of:

S101, selecting a current amplification coefficient of an amplifier signally-connected with a data line in the source driver based on a rate at which the data line charges a current signally-connected sub-pixel unit, the currently selected amplification coefficient being inversely proportional to the rate at which the data line charges a current signally-connected sub-pixel unit; and

S102, the amplifier adjusting a received data signal based on the currently selected amplification coefficient, and outputting the adjusted data signal to a data line that is currently signally-connected with the amplifier.

In the driving method of a liquid crystal display panel provided in the embodiment of this invention, based on a rate at which a data line charges a current signally-connected sub-pixel unit, a current amplification coefficient of an amplifier signally-connected with the data line in the source driver can be selected, and the currently selected amplification coefficient is inversely proportional to the rate at which the data line charges a current signally-connected sub-pixel unit; the amplifier adjusts a received data signal based on the currently selected amplification coefficient, and outputs the adjusted data signal to a data line that is currently signally-connected with the amplifier. Hence, for the case that the rate at which the data line charges the sub-pixel unit is relatively low, a relative large amplification coefficient can be selected, thereby nonuniform brightness of the display image caused by a low charging rate of the sub-pixel unit can be avoided; for the case that the rate at which the data line charges the sub-pixel unit is relatively high, a relatively small amplification coefficient is selected, thereby unnecessary power consumption can be saved.

The embodiments of this invention provide a liquid crystal display panel, a display device and a driving method of a liquid crystal display panel, in the liquid crystal display panel, the source driver comprises an amplifier whose amplification coefficient is adjustable, the amplifier can adjust a received data signal based on a currently selected amplification coefficient, and output the adjusted data signal to a data line that is currently signally-connected with the amplifier, moreover, the currently selected amplification coefficient is inversely proportional to a rate at which the data line charges a current signally-connected sub-pixel unit. Hence, for the case that the rate at which the data line charges the sub-pixel unit is relatively low, a relative large amplification coefficient can be selected, thereby nonuniform brightness of the display image caused by a low charging rate of the sub-pixel unit can be avoided; for the case that the rate at which the data line charges the sub-pixel unit is relatively high, a relatively small amplification coefficient is selected, thereby unnecessary power consumption can be saved.

Apparently, the skilled person in the art can make various modifications and variants to this invention without departing from the spirit and scope of this invention. In this way, provided that these modifications and variants belong to the scope of the claims of this invention and the equivalent technology thereof, this invention also intends to cover these modifications and variants.

DRAWINGS OF THE DESCRIPTION

FIG. 7

S101, selecting a current amplification coefficient of an amplifier signally-connected with a data line in the source driver based on a rate at which the data line charges a current signally-connected sub-pixel unit, the currently selected amplification coefficient being inversely proportional to the rate at which the data line charges a current signally-connected sub-pixel unit; and S102, the amplifier adjusting a received data signal based on the currently selected amplification coefficient, and outputting the adjusted data signal to a data line that is currently signally-connected with the amplifier.

The invention claimed is:

1. A liquid crystal display panel comprising an array substrate, data lines located on the array substrate, sub-pixel units signally-connected with the data lines, and a source driver signally-connected with each of the data lines, wherein:

the source driver comprises an amplifier whose amplification coefficient is adjustable, the amplifier being used for adjusting a received data signal based on a currently selected amplification coefficient, and outputting the adjusted data signal to a data line that is currently signally-connected with the amplifier, wherein the currently selected amplification coefficient is inversely proportional to a rate at which the data line charges a current signally-connected sub-pixel unit.

2. The liquid crystal display panel as claimed in claim 1, wherein the amplifier comprises a plurality of positive signal amplifiers and a plurality of negative signal amplifiers, the source driver further comprises:

a first adjustment unit adjusting amplification coefficient of the positive signal amplifier; and a second adjustment unit adjusting amplification coefficient of the negative signal amplifier, the first adjustment unit is connected between a negative phase signal input end of the positive signal amplifier and an output end of the positive signal amplifier in series, and the second adjustment unit is connected between a positive phase signal input end of the negative signal amplifier and an output end of the negative signal amplifier in series.

3. The liquid crystal display panel as claimed in claim 2, wherein the first adjustment unit and the second adjustment unit comprise resistances whose resistance values are adjustable.

4. The liquid crystal display panel as claimed in claim 2, wherein the source driver further comprises an output polarity control unit, wherein an odd numbered data line and an even numbered data line are taken as a group of data lines, the group of data lines are connected with a positive signal amplifier and a negative signal amplifier respectively through the output polarity control unit, at a first moment, the output polarity control unit turns on the positive signal amplifier and the odd numbered data line, the output polarity control unit turns on the negative signal amplifier and the even numbered data line, and at a second moment, the output polarity control unit turns on the positive signal amplifier and the even numbered data line, the output polarity control unit turns on the negative signal amplifier and the odd numbered data line.

5. The liquid crystal display panel as claimed in claim 4, wherein the source driver further comprises:

first digital to analog conversion units in one-to-one correspondence with the plurality of positive signal amplifiers; and second digital to analog conversion units in one-to-one correspondence with the plurality of negative signal amplifiers, the first digital to analog conversion unit being used for performing digital to analog converstion to a received positive gamma voltage, and outputting the digital to analog converted positive gamma voltage to a positive phase signal input end of a corresponding positive signal amplifier;

the second digital to analog conversion unit being used for performing digital to analog converstion to a received negative gamma voltage, and outputting the digital to analog converted negative gamma voltage to a negative phase signal input end of a corresponding negative signal amplifier.

6. The liquid crystal display panel as claimed in claim 1, wherein a data line is signally-connected with a corresponding column of sub-pixel units, the even numbered data line is signally-connected with the source driver through a first wiring, the odd numbered data line is signally-connected with the source driver through a second wiring, wherein, the first wiring and the second wiring are arranged in different layers on the array substrate.

7. The liquid crystal display panel as claimed in claim 1, wherein, two adjacent columns of sub-pixel units are taken as a group of sub-pixel unit columns, each group of sub-pixel columns share a data line located between the two columns of sub-pixel units, and there are two gate lines between sub-pixel units of adjacent rows.

8. A display device comprising a liquid crystal display panel, the liquid crystal display panel comprising an array substrate, data lines located on the array substrate, sub-pixel units signally-connected with the data lines, and a source driver signally connected with each of the data lines, wherein:

the source driver comprises an amplifier whose amplification coefficient is adjustable, the amplifier being used for adjusting a received data signal based on a currently selected amplification coefficient, and outputting the adjusted data signal to a data line that is currently signally-connected with the amplifier, wherein the currently selected amplification coefficient is inversely proportional to a rate at which the data line charges a current signally-connected sub-pixel unit.

9. The display device as claimed in claim 8, wherein the amplifier comprises a plurality of positive signal amplifiers and a plurality of negative signal amplifiers, the source driver further comprises:

a first adjustment unit adjusting amplification coefficient of the positive signal amplifier; and a second adjustment unit adjusting amplification coefficient of the negative signal amplifier, the first adjustment unit is connected between a negative phase signal input end of the positive signal amplifier and an output end of the positive signal amplifier in series, and the second adjustment unit is connected between a positive phase signal input end of the negative signal amplifier and an output end of the negative signal amplifier in series.

10. The display device as claimed in claim 9, wherein the first adjustment unit and the second adjustment unit comprise resistances whose resistance values are adjustable.

11. The display device as claimed in claim 9, wherein the source driver further comprises an output polarity control unit, wherein an odd numbered data line and an even numbered data line are taken as a group of data lines, the group of data lines are connected with a positive signal amplifier and a negative signal amplifier respectively through the output polarity control unit, at a first moment, the output polarity control unit turns on the positive signal amplifier and the odd numbered data line, the output polarity control unit turns on the negative signal amplifier and the even numbered data line, and at a second moment, the output polarity control unit turns on the positive signal amplifier and the even numbered data line, the output polarity control unit turns on the negative signal amplifier and the odd numbered data line.

12. The display device as claimed in claim 9, wherein the source driver further comprises:

first digital to analog conversion units in one-to-one correspondence with the plurality of positive signal amplifiers; and second digital to analog conversion units in one-to-one correspondence with the plurality of negative signal amplifiers, the first digital to analog conversion unit being used for performing digital to analog converstion to a received positive gamma voltage, and outputting the digital to analog converted positive gamma voltage to a positive phase signal input end of a corresponding positive signal amplifier;

the second digital to analog conversion unit being used for performing digital to analog converstion to a received negative gamma voltage, and outputting the digital to analog converted negative gamma voltage to a negative phase signal input end of a corresponding negative signal amplifier.

13. The display device as claimed in claim 8, wherein a data line is signally-connected with a corresponding column of sub-pixel units, the even numbered data line is signally-connected with the source driver through a first wiring, the odd numbered data line is signally-connected with the source driver through a second wiring, wherein, the first wiring and the second wiring are arranged in different layers on the array substrate.

14. The display device as claimed in claim 8, wherein, two adjacent columns of sub-pixel units are taken as a group of sub-pixel unit columns, each group of sub-pixel columns share a data line located between the two columns of sub-pixel units, and there are two gate lines between sub-pixel units of adjacent rows.

15. A driving method of a liquid crystal display panel, comprising:

selecting a current amplification coefficient of an amplifier signally-connected with a data line in the source driver based on a rate at which the data line charges a current signally-connected sub-pixel unit, the currently selected amplification coefficient being inversely proportional to the rate at which the data line charges a current signally-connected sub-pixel unit;

the amplifier adjusting a received data signal based on the currently selected amplification coefficient, and outputting the adjusted data signal to a data line that is currently signally-connected with the amplifier.

* * * * *